United States Patent [19]

Hooper et al.

[11] Patent Number: 4,570,923

[45] Date of Patent: Feb. 18, 1986

[54] CONVEYING APPARATUS

[75] Inventors: Clinton E. Hooper, Brookfield; Harold Silverman, Wilton, both of Conn.

[73] Assignee: Pitney Bowes Inc., Stamford, Conn.

[21] Appl. No.: 683,753

[22] Filed: Dec. 19, 1984

[51] Int. Cl.[4] ..... B65H 5/02

[52] U.S. Cl. ..... 271/275; 271/273

[58] Field of Search ..... 271/273, 274, 275; 355/3 GH, 14 SH

[56] References Cited

U.S. PATENT DOCUMENTS 4,017,169 4/1977 Komura ..... 271/273 X 4,146,219 3/1979 Phillips ..... 271/275

*Primary Examiner*—Richard A. Schacher

*Attorney, Agent, or Firm*—Martin D. Wittstein; William D. Soltow, Jr.; Albert W. Scribner

[57] ABSTRACT

Sheet processing machinery including a bursting machine and a folding machine has a sheet conveying apparatus disposed there-between. The sheet conveying apparatus is pivotably mounted to allow service to an area adjacent to the input end of the following machine. A drive apparatus connected to the sheet processing machinery is disengaged to allow upward pivoting of the sheet conveying apparatus from a horizontal position to a retracted position, whereupon the service access may be achieved.

6 Claims, 6 Drawing Figures

CONVEYING APPARATUS

BACKGROUND OF THE INVENTION

1. Field of the Invention

The present invention relates to sheet conveying apparatus which is interconnected with sheet processing machinery. There is presently in use a new generation of sheet and document processing machinery which typically bursts preformed perforated webs into discreet sheets. These sheets are then conveyed along one or more feed paths leading to a sheet processing station such as a folding unit. Sheet processing machinery as such with folding units included, is increasingly being utilized in the modern office where space is at a premium among many other kinds of office equipment. It is therefore a trend that such machinery be designed in a more compact arrangement which compliments the modern office. The necessity for gaining service access to interior areas of the sheet processing machinery remains as a consideration for proper jam clearing capability, along with service requirements. It is with the foregoing in mind that the present invention has evolved in view of the following mentioned example of prior art.

2. Prior Art

U.S. Pat. No. 4,083,553, issued to Beck et al. Apr. 11, 1978 discloses a Copy Sheet Handling Apparatus for a Copier. One object of this patent is to provide means for accessing the copy sheet supply tray in a prescribed manner to avoid copy sheets from becoming misplaced during operator loading of additional sheets to the supply tray. This is accomplished partly by the use of a pivotable apparatus which maintains the feeding and sheet alignment devices in a predetermined sequence, thereby ensuring proper alignment of the sheets at the feeding position. While the referenced patent does provide access capability to the sheet feeding instrumentalities of the copier in this case, the device is not suitable for providing access in a sheet processing machine where a sheet, or series of sheets are conveyed along a path between modular units, since the patented bar device, aligning apparatus and restraining devices are designed for a one ended sheet feeding apparatus whereas the present invention must handle a stream flow of such sheets and yet be jam accessible as previously mentioned in the background of the invention.

SUMMARY OF THE INVENTION

There is a sheet conveying apparatus disclosed for transferring successive sheets of paper from a first sheet processing machine having a pair of substantially vertically oriented sheet feed rollers adjacent an output end. There is a second sheet processing machine having an input end located at the end which is opposite from the end disposed adjacent to the output feed rollers of the first sheet processing machine. The sheet conveying apparatus includes an elongate frame pivotally connected to the second sheet processing machine adjacent to the input end. The sheet conveying apparatus is normally disposed in a substantially horizontal position so that the frame normally overlies the second sheet processing machine. There is a sheet conveying device mounted on the frame, extending substantially the length of the frame for conveying sheets from the output end of the first sheet processing machine to the input end of the second sheet processing machine. A drive apparatus is operatively connected to the sheet conveying device, and is movably mounted on the free end of the frame for movement between an extended position in which the drive apparatus is engaged in driving relationship with the lower feed roller of the pair of feed rollers and is in interferring relationship with both the lower and upper feed rollers, thereby preventing upward movement of the free end of the frame. There is a retracted position in which the drive apparatus is disengaged from the lower feed roller and is out of interferring relationship with the lower and upper feed rollers, thereby permitting upward movement of the free end of the frame. A manually operable apparatus is provided for selectively moving the drive apparatus from the extended position to the retracted position so that the sheet conveying apparatus can be pivotally raised to an inclined position to facilitate operator access to the space beneath the sheet conveying apparatus.

The sheet conveying apparatus includes an endless belt and at least a first shaft supporting the belt, adjacent an inlet end of the frame. And, the drive apparatus includes a friction roller carried by a second shaft and an apparatus pivotally mounted on the frame adjacent to the inlet end thereof for supporting the second shaft in a position parallel to but spaced outwardly from the first shaft.

Having described the sheet conveying apparatus of the present invention, it is now presented that it is an object of the present invention to provide a way of conveying sheets from a first processing machine to a second processing machine such that access to adjacent working components of the second processing machine may be provided without disengaging the machines.

It is another object of the present invention to provide a sheet conveying apparatus having a manually disengagable drive for providing individual sheets to the operator as they are processed in the first sheet processing machine.

DETAILED DESCRIPTION

Figure 1:
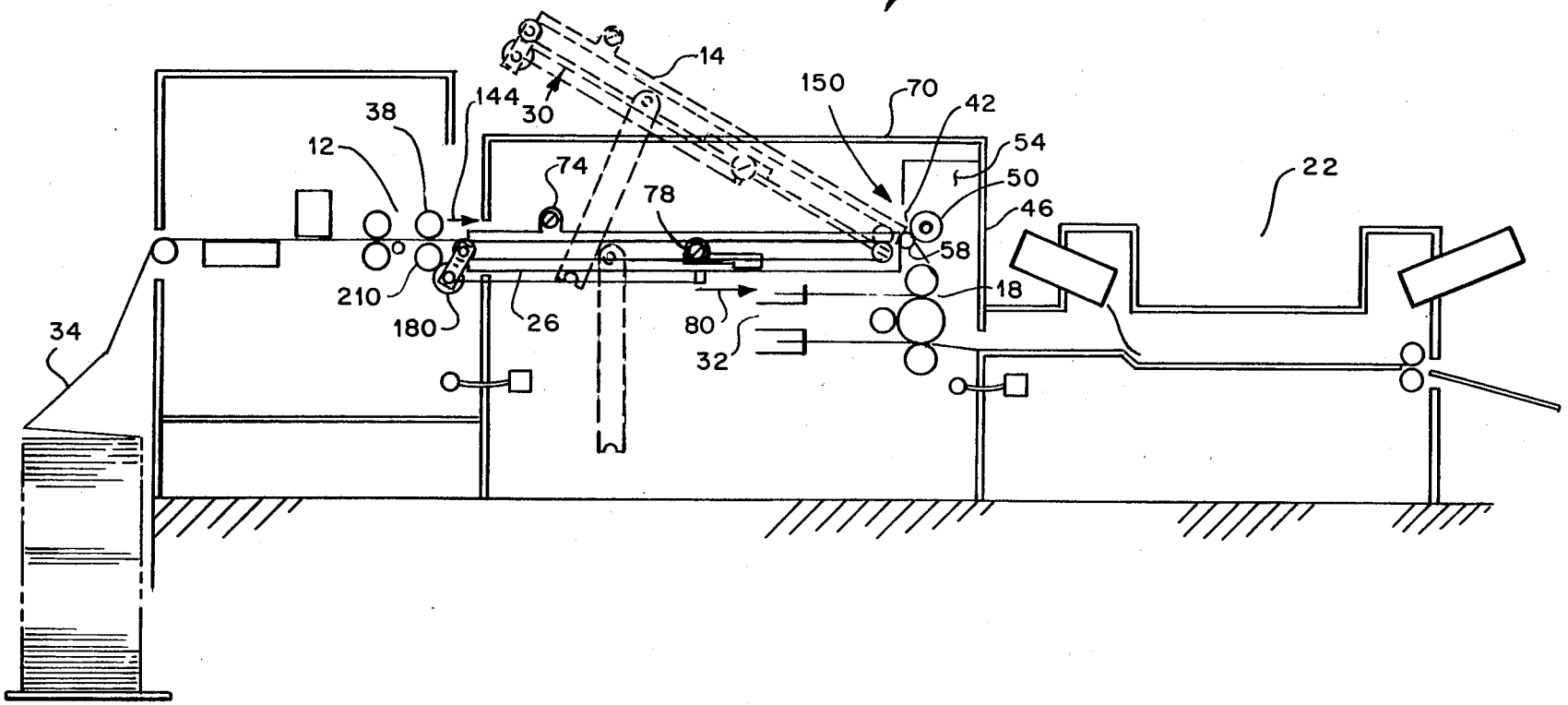
FIG. 1 is a front view of a sheet processing machine including a bursting machine, a sheet conveying apparatus, a folding machine and an inserting machine.

Referring to FIG. 1, there is shown a front view of a sheet processing machine 10 which includes a bursting machine 12, a sheet conveying apparatus 14, a folding machine 18, and an inserting machine 22, all of which will be understood to be functional as a unit within the sheet processing machine 10. The sheet conveying apparatus 14 normally lies in a substantially horizontal position 26 such that it is parallel to ground. There is a retracted position 30 shown in FIG. 1, which represents the service position to gain access to a number of sheet buckle chutes 32 within the folding machine 18.

Figure 2:
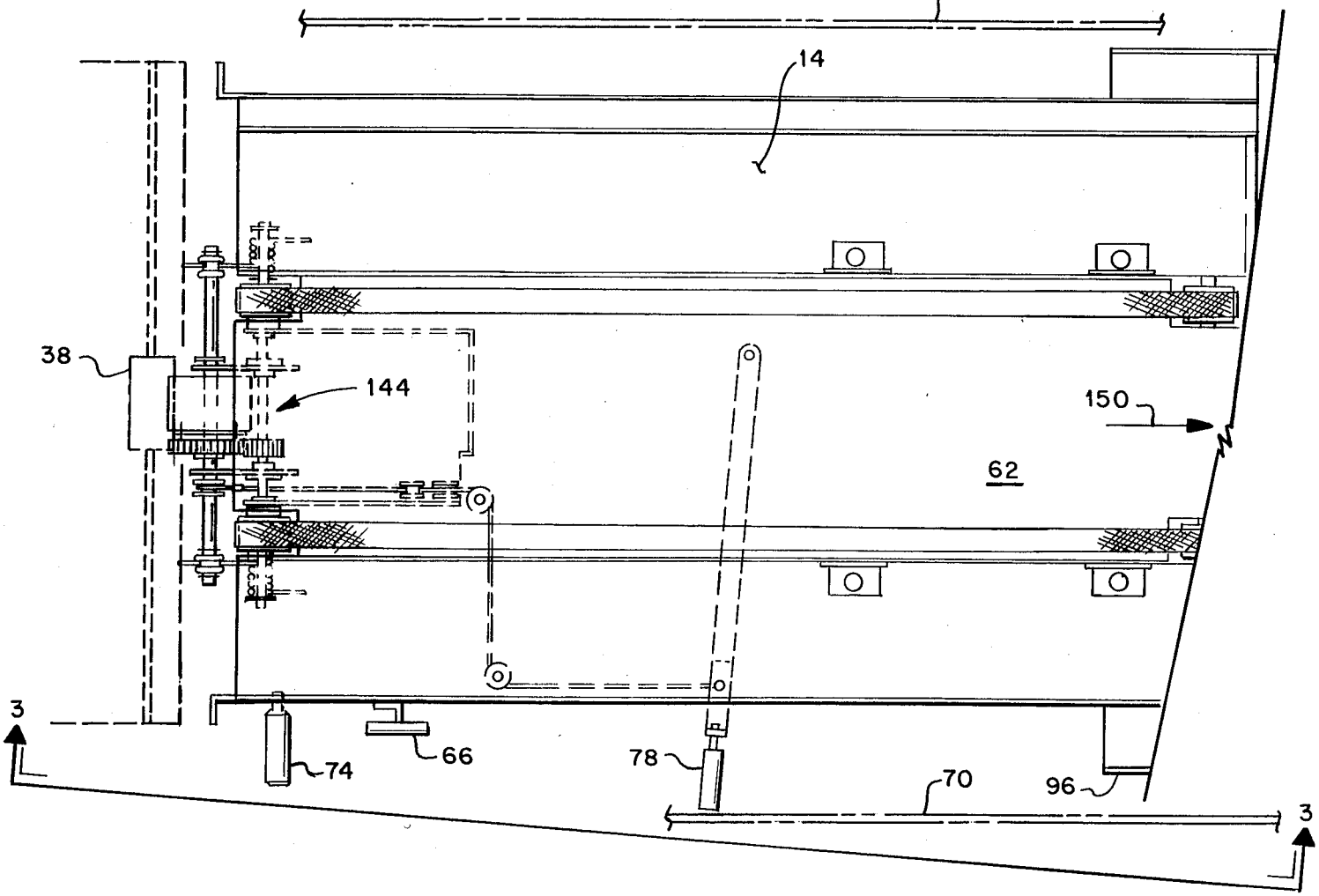
FIG. 2 is a partial top view of the sheet conveying apparatus of FIG. 1.

At this point it will be helpful to mention that a copending patent application, Ser. No. 569,413 entitled "Sheet Processing Apparatus" as assigned to Pitney Bowes Inc., will be useful insofar as explaining the detailed instrumentalities of the sheet processing machine 10. In this respect, a perforated web 34 is fed into the bursting machine 12 which then separates sheets from the web 34, and conveys the separated sheets through a pair of substantially vertically oriented sheet feed rollers 38, which are part of the bursting machine 12, hereinafter referred to as a first sheet processing machine. Similarly, the folding machine 18 will be referred to as a second sheet processing machine, having an input end 42, defined by a mating pair of rollers 46. There is an upper roller 50, which is drivingly located on a frame 54 (FIG. 2) of the second sheet processing machine 18 such that a roller 58, rotatably located on a support member 62 within the sheet conveying apparatus 14 (FIG. 3), normally engages the upper roller 50 when the sheet conveying apparatus 14 is disposed in the substantially horizontal position 26 illustrated in FIG. 1.

Figure 3:
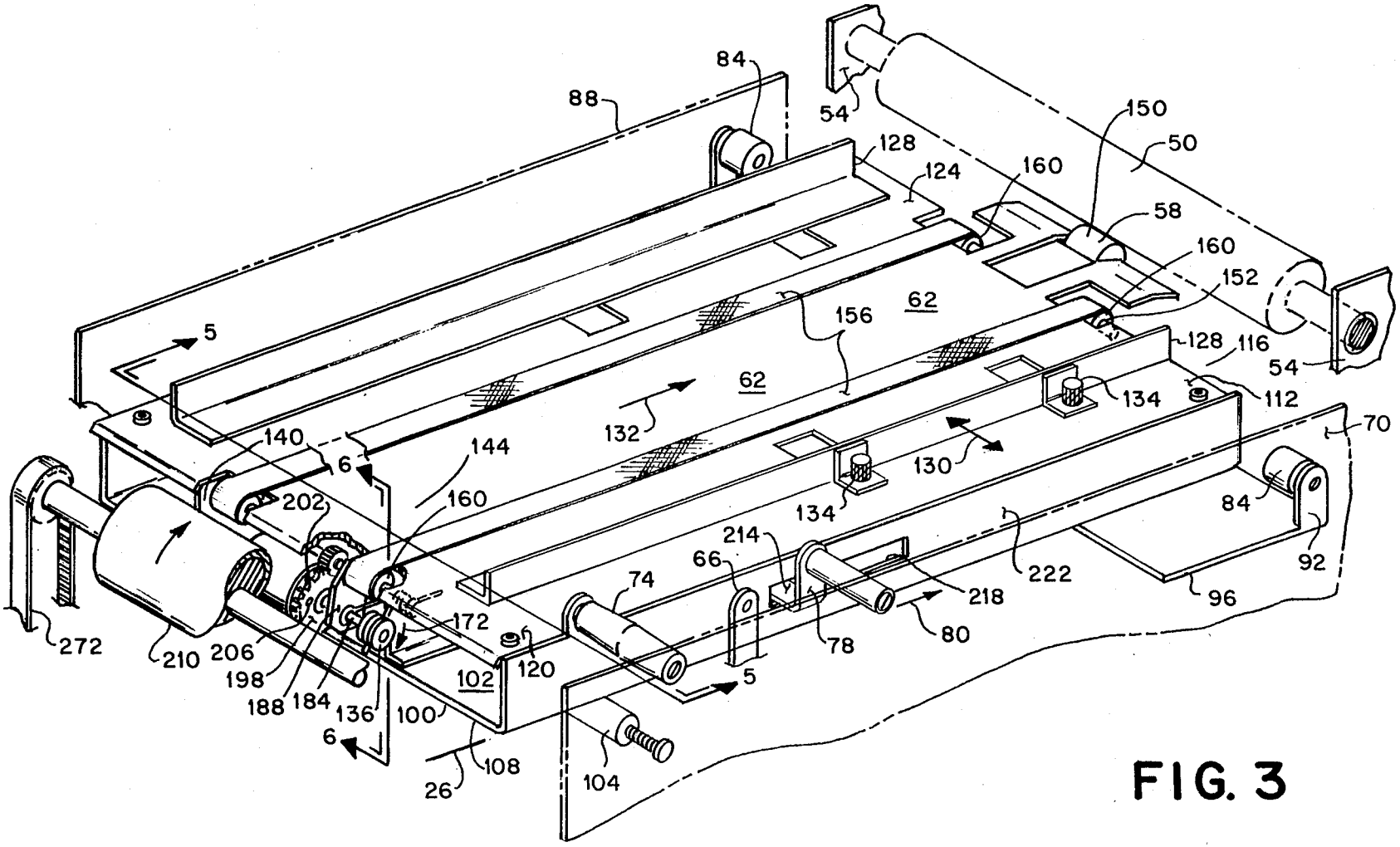
FIG. 3 is an elevated, enlarged isometric view of the conveying apparatus taken from FIG. 2 along the lines of 3—3.

In FIG. 1, it is seen that the sheet conveying apparatus 14 is held upwards at the retracted position 30 by a suitable pivoting notched link member 66. In FIG. 3, there is shown a front wall 70 which partially obscures the operator's view of a handle member 74, unless the operator stands close to the front wall 70. The handle member 74 is suitably fastened to the sheet conveying apparatus 14. There is a manually operable apparatus 78 which an operator will grasp and move in a direction indicated by an arrow 80 in order to raise the sheet conveying apparatus 14 to the retracted position 30. The handle 74 is also grasped to rotate the apparatus 14 towards the retracted position 30. In FIG. 3, more details of the construction of the sheet conveying apparatus 14 is seen, including a pivot screw member 84, which secures the sheet conveying apparatus 14 as an assembly to the front wall 70, and similarly to a rear wall 88. There is a bent tab 92 formed from a lower structural member 96, in turn appropriately attached to an elongate U-shaped frame member 100 (FIG. 3). The frame member 100 forms the basic base assembly frame for the entire sheet conveying apparatus 14. There is a bar 104, appropriately attached to the front and rear wall 70 and 88 respectively, in order that a lower surface 108 of the U-shaped frame member 100 may rest in the aforementioned, substantially horizontal position 26. There is an upper cover member 112 which functions as a paper deck, located on a front side 116 of the sheet conveying apparatus 14, and is appropriately attached to the U-shaped frame member 100 by suitable screws and bent tabs as for example at a corner 120. The upper cover member 112 is similar to a rear upper cover member 124, which is fastened to the U-shaped frame member 100 in a manner similar to the member 112. There are appropriate sheet guide members, such as an angled member 128, which is slidably adjustable (there are two such members disposed at the front and rear of the sheet conveying apparatus 14), in a lateral direction 130 as opposed to a direction of sheet travel indicated by an arrow 132. The angled member 128 is normally held in a predetermined position by a lockscrew 134 which is typical of 4 such screws for adjusting the angled member 128.

Figure 4:
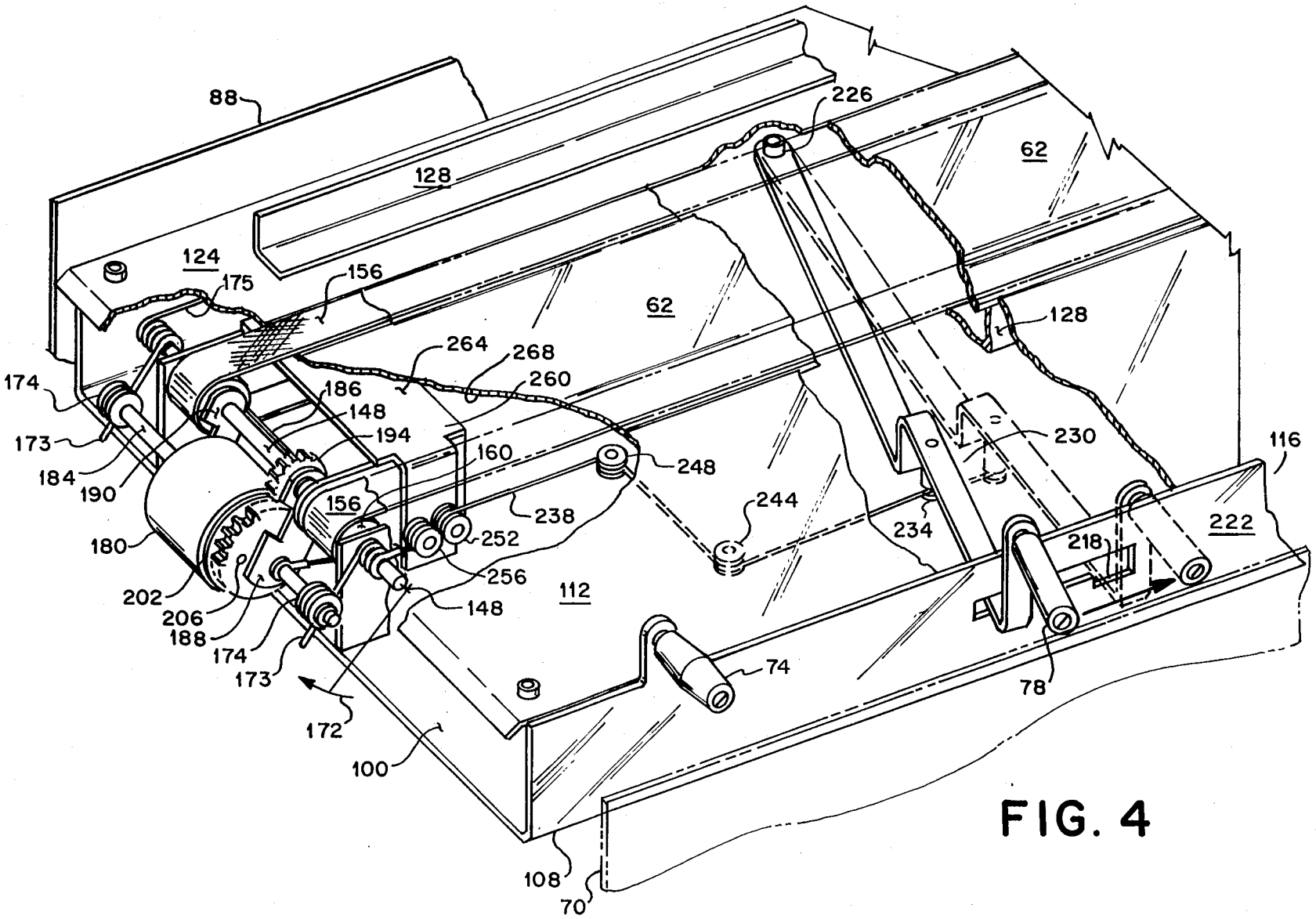
FIG. 4 is a partial sectional view of the sheet conveying apparatus as taken from FIG. 3.
Figure 5:
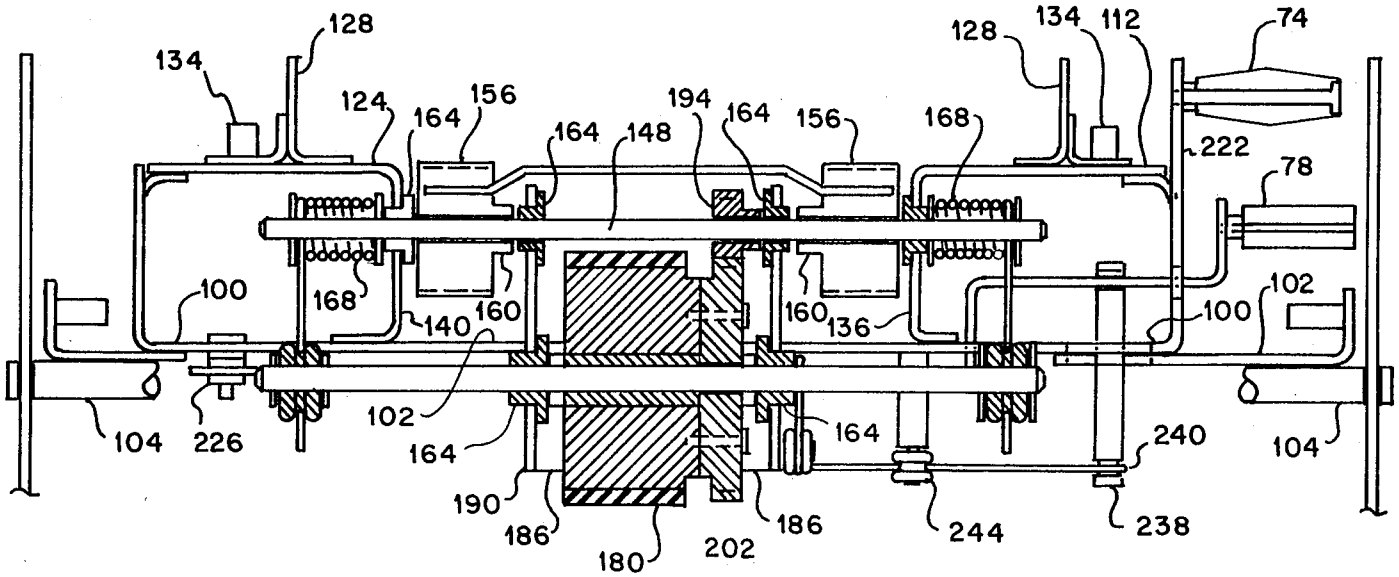
FIG. 5 is a section view of the conveying apparatus as taken from FIG. 3 along the lines of 5—5.
Figure 6:
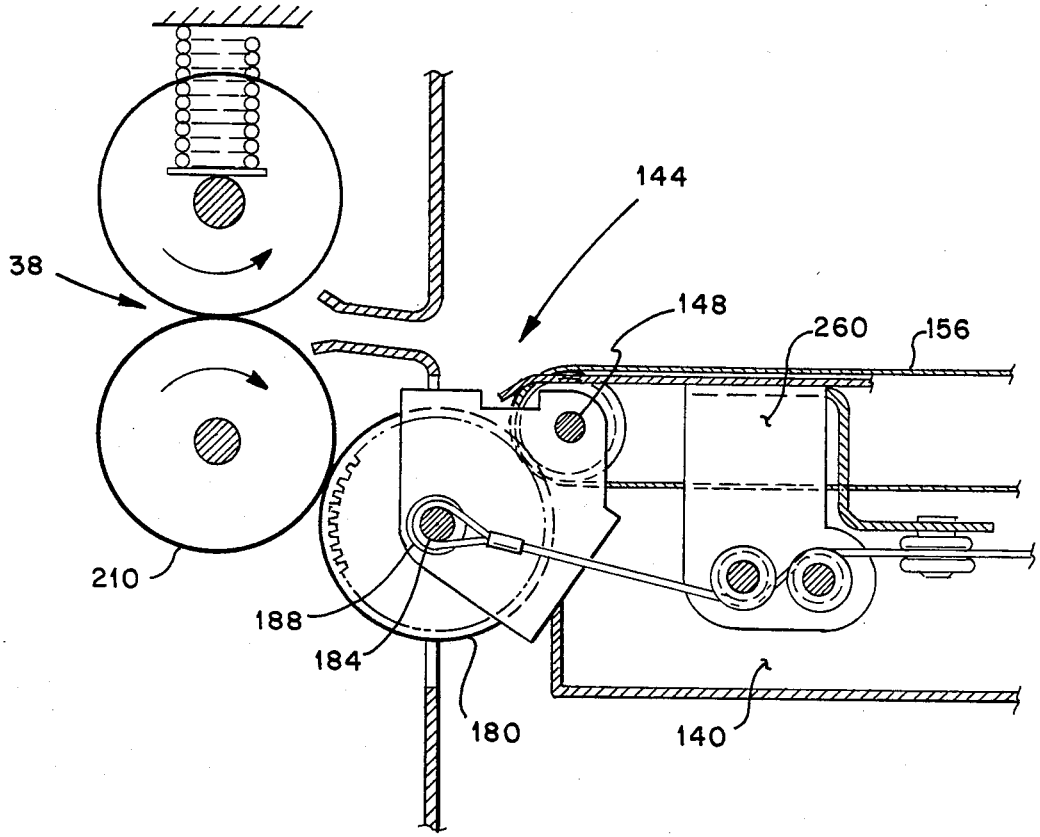
FIG. 6 is a partial front view of the sheet conveying apparatus as taken from FIG. 3 along the lines of 6—6.

Referring to FIG. 5, some more of the structural construction of the sheet conveying apparatus is seen. The upper cover member 112 and the rear upper cover member 124 both have vertical legs 136 and 140 respectively. The vertical legs 136 and 140 are appropriately secured to the U-shaped frame member 100 on an inside surface 102 and are elongated so as to reach along the entire length of the sheet conveying apparatus 14. Referring to FIG. 3 and FIG. 4, the legs 136 and 140 reach to an inlet end 144 of the sheet conveying apparatus sufficiently enough to rotatably support a first shaft 148 (FIG. 4), and another shaft 152 which is spaced outwardly from the first shaft 148 at an input end 150 to the second sheet processing machine 18 so as to suspend a pair of endless belts 156 on appropriate friction pulleys such as a pulley 160. The pulley 160 is appropriately fastened to the first shaft 148 by a setscrew or other similar device such that rotation of the first shaft 148 causes movement of the pair of belts 156 in the direction of the arrow 132. There are suitable oilless bearings such as a bearing 164 (FIG. 5) in the vertical leg 140 which rotatably supports the first shaft 148. The bearing 164 is used in other places of the sheet conveying apparatus 14, and will be referred to as other shafts are referred to in the remaining specification.

The first shaft 148 extends laterally beyond the vertical legs 136 and 140 sufficiently enough to hold a torsion spring 168 at both ends. The torsion spring 168 is applied at both ends of the shaft 148 and will be understood to be wound left and right hand in order to provide a moment 172, as indicated by a CW arrow in FIG. 4. The moment 172 is applied to a drive apparatus 176 (FIG. 4), such that a friction wheel 180 is resiliently biased in the clockwise direction given by the moment 172. The moment 172 is applied by a leg 173 of the spring 168 bearing against a grooved pulley 174 which is rotatably mounted on the second shaft 184. A leg 175 of the spring 168 bears against the upper cover member 112. The friction wheel 180 is rotatably mounted on a second shaft 184 and the second shaft 184 in turn is mounted in a bearing 164 which is fixedly located in separate flanges of a bracket 186. A flange 188 and a flange 190 support a bearing 164, in which the aforementioned second shaft 184 is suspended. The bracket 186 is pivotably suspended on the first shaft 148. There is a pinion gear 194 securely fastened to the shaft 148, and there is a gear 198 mounted on the second shaft 184 coaxially with the friction wheel 180. The gear 198 is suitably fastened to a metal portion 202 of the friction wheel 180 by appropriate screws such as a screw 206.

On FIG. 1, it is seen that the friction wheel 180 is in contact with a lower roller 210 of the vertically oriented sheet feed rollers 38 while the sheet conveying apparatus 14 is disposed in the substantially horizontal position 126.

In order for an operator to lift the sheet conveying apparatus 14, it is necessary that the manually operable apparatus 78 be moved in the diection of arrow 80 (FIGS. 1 and 4), until a bent sheet metal link member 214 (FIG. 4), engages a notch 218 which is located in a front upright wall 222 of the U-shaped frame member 100. The bent sheet metal link member 214 is pivotably mounted beneath the lower surface 108 of the U-shaped frame member 100 by a pin 226. The link member 214 is suitably bent to pass through a large aperture 230 (FIG. 4) which additionally accommodates a vertically disposed stud 234. The stud 234 protrudes beneath the level of the surface 108, and a suitable flexible cable 238 is suitably fastened to a groove 240 (FIG. 5) of the stud 234. A horizontal grooved pulley 244 (FIG. 4) and 248 are each rotatably fixed and mounted beneath surface 108 and the flexible cable 238 is strung around them as the cable 238 spans towards two vertically mounted pulleys 252 and 256. The pulleys 252 and 256 are each rotatably mounted on a vertical flange 260 of a U-shaped bracket 264 (FIG. 4). The U-shaped bracket 264 is spot welded to an underside surface 268 of the support member 62. Finally, the flexible cable 238 spans to the second shaft 184 and is firmly tied there.

It will now become evident that moving the manually operable apparatus 78 in the direction of the arrow 80 causes the friction wheel 180 to move away from the lower roller 210 of the vertically oriented sheet feed rollers 38 such that the sheet conveying apparatus 14 may be raised to the previously described retracted position 30. This retracted position 30 provides room and access for the machine operator to reach the sheet buckle chutes 32 of the folding machine 18, as previously described.

And, when the sheet conveying apparatus 14 is in the substantially horizontal position 26, the friction wheel 180 effectively engages the lower roller 210 of the verticaly oriented sheet feed rollers 38. Since the lower roller 210 is appropriately driven by a timing belt 272 which is itself driven by an (unshown) motor, the friction drive to the friction wheel 180 is effectively transferred. The drive apparatus 176 including the gear 198, and pinion gear 194 causes the first shaft 148 to turn and, the pulley 160 holding the previously defined pair of belts 156, thereby providing a conveyor for sheets.

Having described an embodiment of the present invention in detail in the foregoing specification, it will be understood that the sheet conveying apparatus provided herein overcomes obstacles otherwise preventing ready access to the instrumentalities of sheet processing machinery where major components of that machinery are separated. It is to be further understood that the invention is not to be limited to the specific embodiment disclosed herein, the same being merely illustrative of the base mode to carry out the invention, but rather that the invention is intended to cover all such modifications, variations and equivalents thereof as may be deemed to be within the scope of the following claims.

What is claimed is:

1. A sheet conveying apparatus for transferring successive sheets of paper from a first sheet processing machine having a pair of substantially vertically oriented sheet feed rollers adjacent an output end thereof to a second sheet processing machine having an input end located at the end thereof opposite from the end disposed adjacent to the output feed rollers of the first sheet processing machine, said sheet conveying apparatus comprising:

A. an elongate frame pivotally connected to said second sheet processing machine adjacent the input end thereof and being normally disposed in a substantially horizontal position so that said frame normally overlies said second sheet processing machine, B. sheet conveying means mounted on said frame and extending substantially the length thereof for conveying sheets from said output end of the first sheet processing machine to said input end of the second sheet processing machine, C. drive means operatively connected to said conveying means and being movably mounted on the free end of said frame for movement between an extended position in which said drive means is engaged in driving relationship with the lower feed roller of said pair of feed rollers and is in interferring relationship with both said lower and upper feed rollers thereby preventing upward movement of said free end of said frame, and a retracted position in which said drive means disengaged from said lower feed roller and is out of interferring relationship with said lower and upper feed rollers thereby permitting upward movement of said free end of said frame, and D. manually operable means for selectively moving said drive means from said extended position to said retracted position whereby said sheet conveying apparatus can be pivotally raised to an inclined position to facilitate operator access to the space beneath the sheet conveying apparatus.

2. A sheet conveying apparatus as set forth in claim 1 wherein

A. said sheet conveying means comprises an endless belt and at least a first shaft supporting said belt adjacent an inlet end of said frame, and B. said drive means comprises a friction roller carried by a second shaft and means pivotally mounted on said frame adjacent said inlet end thereof for supporting said second shaft in a position parallel to but spaced outwardly from said first shaft.

3. A sheet conveying apparatus as set forth in claim 2 wherein said manually operable means comprises:

A. a lever mounted on said frame for limited reciprocable motion, and

B. a flexible cable interconnecting said lever and said second shaft whereby reciprocal movement of said lever causes pivotal movement of said second shaft to move said friction roller between said extended and retracted positions to engage and disengage said friction roller with said lower feed roller as aforesaid.

4. A sheet conveying apparatus as set forth in claim 3 wherein said drive means further comprises resilient means normally biasing said support means for said second shaft toward said extended position, said lever and cable being operable to move said second shaft from said extended position to said retracted position against the force of said resilient means.

5. A sheet conveying apparatus as set forth in claim 2 wherein said means pivotally mounting said second shaft comprises a bracket pivotally mounted coaxially with said first shaft, said second shaft being mounted on said bracket in outwardly spaced relationship to said first shaft.

6. A sheet conveying apparatus as set forth in claim 5 wherein said drive means further comprises a first gear mounted on said second shaft for rotation therewith and a second gear fixedly mounted on said first shaft and meshing with said first gear for driving said belt means in response to rotation of said friction wheel when said friction wheel is in driving engagement with said lower feed roller as aforesaid.

* * * * *